US005937477A

United States Patent [19]

Dyson

[11] Patent Number: 5,937,477

[45] Date of Patent: Aug. 17, 1999

[54] VACUUM CLEANER

[75] Inventor: James Dyson, Bathford, United Kingdom

[73] Assignee: Notetry Limited, Little Somerford, United Kingdom

[21] Appl. No.: 08/875,430

[22] PCT Filed: Jan. 24, 1996

[86] PCT No.: PCT/GB96/00145

§ 371 Date: Sep. 30, 1997

§ 102(e) Date: Sep. 30, 1997

[87] PCT Pub. No.: WO96/22726

PCT Pub. Date: Aug. 1, 1996

[30] Foreign Application Priority Data

Jan. 27, 1995 [GB] United Kingdom ..... 9501612

[51] Int. Cl.[6] ..... A47L 5/00

[52] U.S. Cl. ..... 15/327.2; 15/327.5; 15/327.7

[58] Field of Search ..... 15/327.1, 327.2, 15/327.5, 327.7, 338, 339

[56] References Cited

U.S. PATENT DOCUMENTS

| | | | |
|---|---|---|---|
| 3,015,123 | 1/1962 | Descarries . | |
| 5,755,007 | 5/1998 | Dyson | 15/327.5 |

FOREIGN PATENT DOCUMENTS

| | | |
|---|---|---|
| 93 02 645 | 6/1993 | Germany . |
| 50067 | 3/1941 | Netherlands . |
| 65453 | 3/1950 | Netherlands . |
| 658328 | 10/1951 | United Kingdom . |

*Primary Examiner*—David A. Redding
*Attorney, Agent, or Firm*—Ian C. McLeod

[57] ABSTRACT

The invention provides a vacuum cleaner (10) having a housing (12) containing an apparatus (22) for separating dirt and dust from an airflow. The vacuum cleaner is configured so as to allow the cleaner to be positioned on a flight of stairs. The forward end (32) of the housing is shaped so as to facilitate the sliding of the vacuum cleaner over the flight of stairs in an upward direction.

4 Claims, 4 Drawing Sheets

VACUUM CLEANER

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

The invention relates to a vacuum cleaner, particularly to a cylinder-type vacuum cleaner.

2. Description of the Related Art

Very few vacuum cleaners, upright or cylinder, are designed to be stably positioned on a flight of stairs. UK patent No. 658328 discloses a cylinder-type machine having skids attached to the underside of the cylindrical housing, the skids having notches located therein so that the machine can be "hooked" onto a stair nosing. This allows the user use of both hands to operate the hose or wand of the cleaner. A similar but improved design is described in our pending UK patent application No. 2292881A and corresponding PCT application No. WO 96/07350. An alternative design is illustrated in DE-U-9302645.

None of these prior art machines is designed or intended to be moved up or down a flight of stairs other than by the user lifting the entire machine and repositioning it on another convenient part of the flight of stairs. This can be quite cumbersome, especially if the user must also keep hold of the hose or wand during repositioning of the machine. It would be more convenient if the machine could be dragged or slid up the flight without having to physically lift the body of the machine but the configuration of each prior art machine is such that dragging or sliding is difficult and awkward and results in a substantial jolting of the machine. This can be detrimental to the operation of the machine.

U.S. Pat. No. 3,015,123 illustrates a vacuum cleaner which is intended to be slid or pulled up a flight of stairs, but the stability of the machine is insufficient for safe use.

SUMMARY OF THE INVENTION

An object of the invention is to provide a vacuum cleaner which can be easily manoeuvred on a flight of stairs.

The invention provides a vacuum cleaner as set out in claim 1. Advantageous features of the invention are set out in the subsidiary claims.

The shaping of the forward end of the housing to include an upwardly inclined nose adapted to present a smooth, inclined surface to a stair nosing so as to facilitate sliding of the machine up a flight of stairs means that upward sliding of the machine is smoother and less jolting so that the likelihood of damaging the machine by such action is minimised.

BRIEF DESCRIPTION OF THE DRAWINGS

Embodiments of the invention will now be described with reference to the accompanying drawings, wherein.

DETAILED DESCRIPTION OF THE INVENTION

Figure 1:
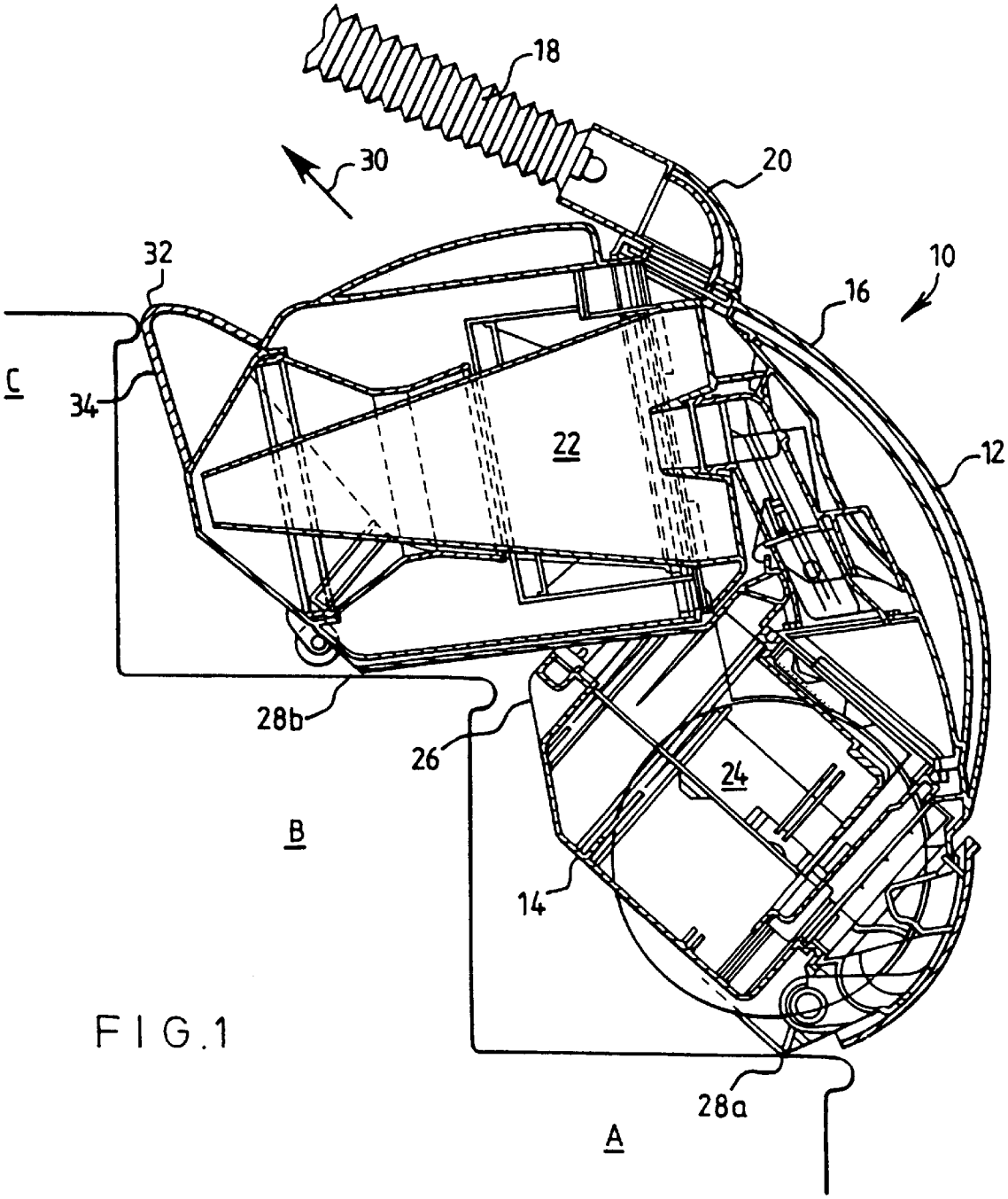
FIG. 1 is a side sectional view of a vacuum cleaner according to the invention positioned on a flight of stairs.
Figure 2A:
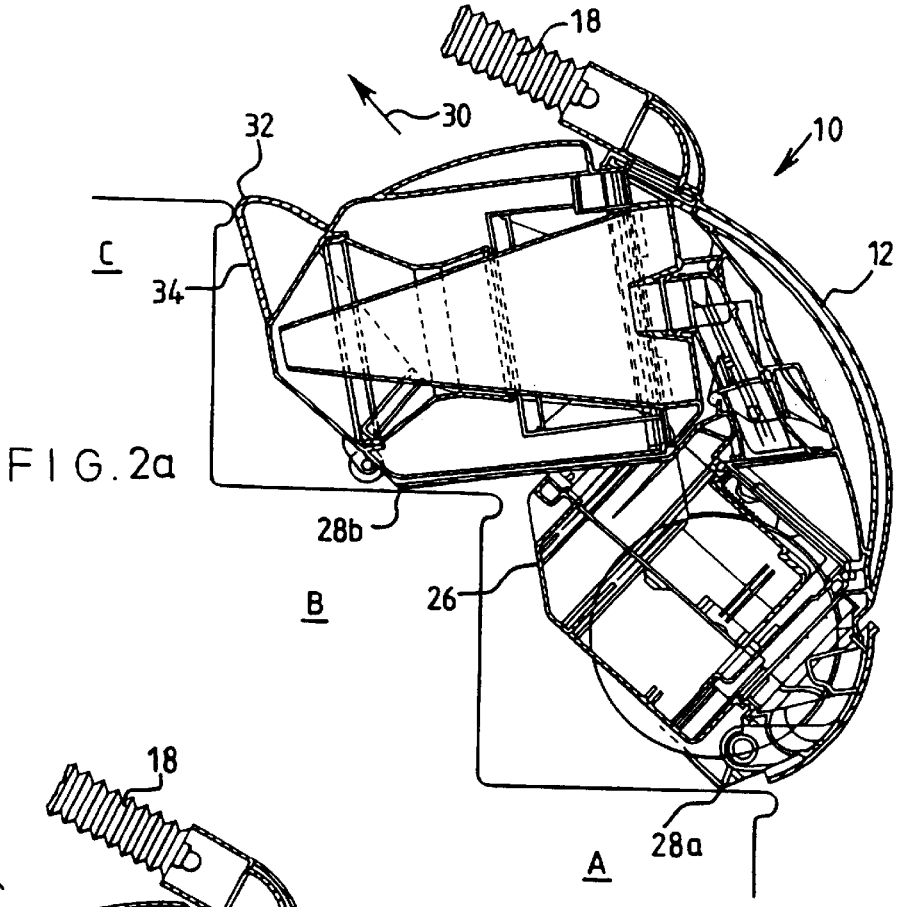
FIGS. 2*a*–2*d* illustrate progressive positions of the vacuum cleaner when caused to slide upon a flight of stairs in the upward direction.
Figure 2B:
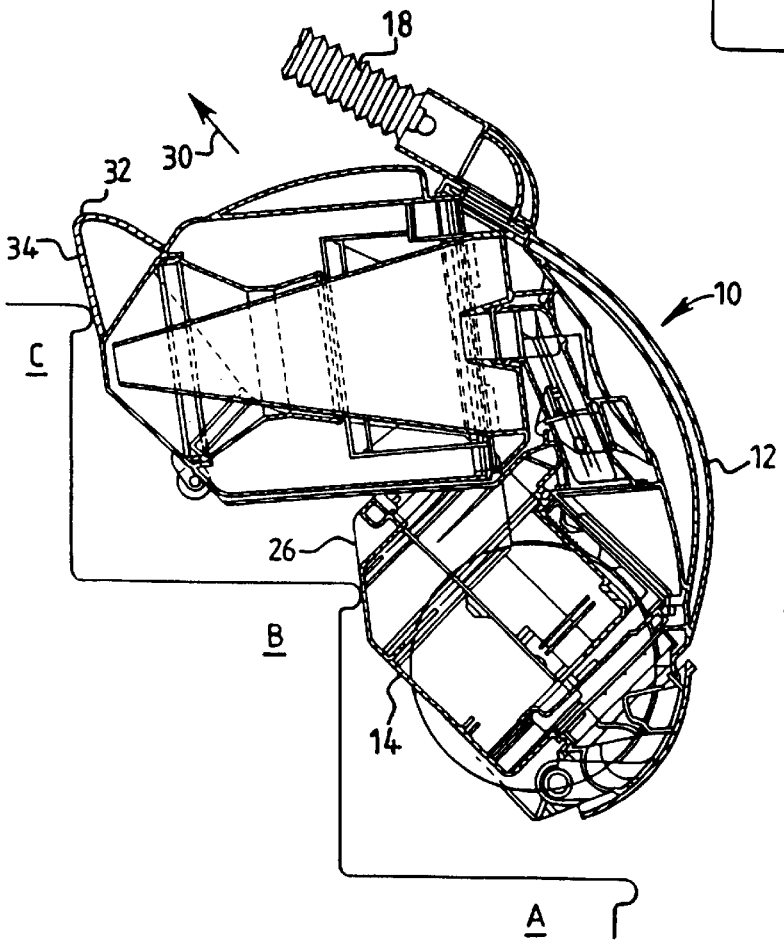
Figure 2C:
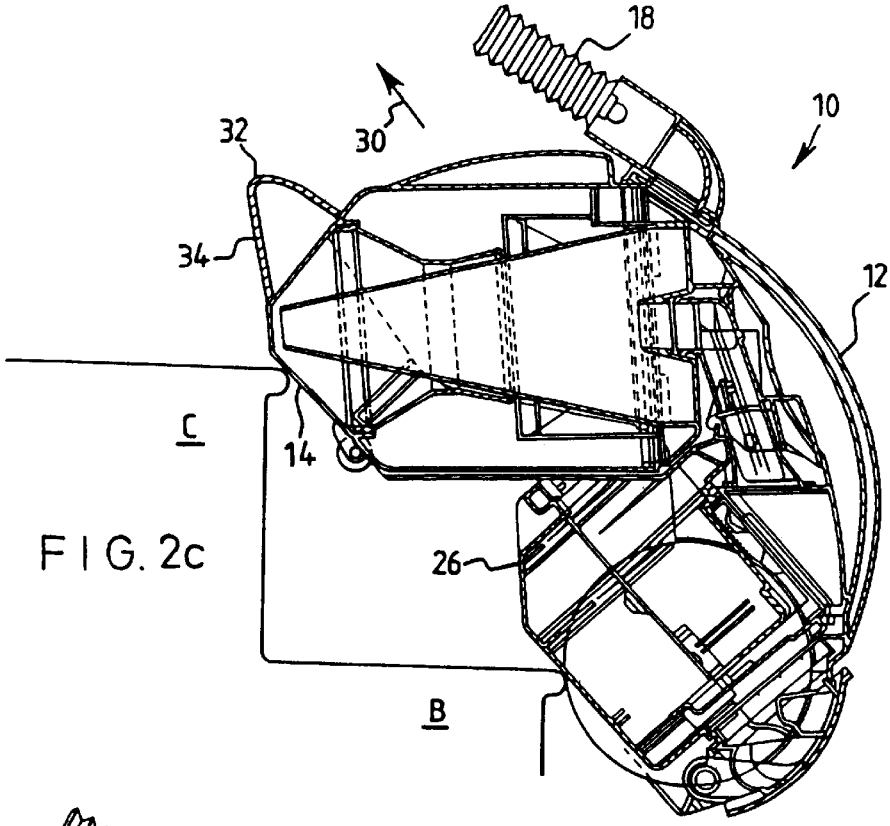
Figure 2D:
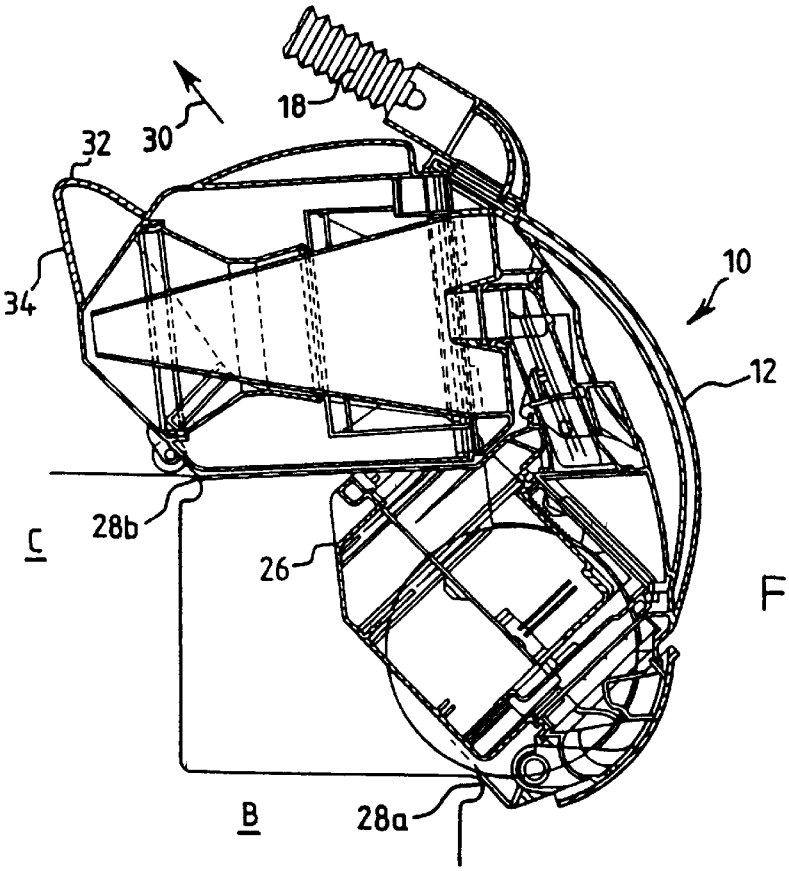

A vacuum cleaner according to the present invention is illustrated in FIG. 1. The vacuum cleaner 10 consists essentially of a housing 12 having a base 14 and a cover 16. A hose 18 is connected to the cover 16 of the housing 12 by means of a swivel coupling 20. Positioned inside the housing 12 are dust separating apparatus 22, a motor 24 and connection means for causing the vacuum cleaner to operate so as to draw dirty air into the housing 12 along the hose 18, to separate dirt and dust particles from the air flow, and to expel clean air to the atmosphere. The interior workings of the machine 10 do not form an essential part of the present invention and will not be described any further here.

The base 14 of the cover 12 incorporates a recess 26 which can accommodate the nosing of a stair tread. By means of this shaping, which forms the subject of our pending UK patent application No. 2292881A and PCT application No. WO 96/07350, the machine 10 can be positioned on a flight of stairs in a stable manner. The base 14 of the cover 12 rests on adjacent stair treads A, B at contact portions 28*a*, 28*b*.

When the machine 10 is in use, there is a desire on the part of the user to drag the machine 10 up the flight of stairs merely by pulling on the hose 18. In order to facilitate the sliding of the machine 10 up the stairs in the direction of the arrow 30, a nose or shaping 32 is provided on the forward end of the housing 12. The nose 32 projects forwardly of the casing 12 and is inclined upwardly with respect to the general plane of the base 14 of the cover 12 such that, when the user applies a pulling force to the hose 18 in the direction of arrow 30, the nose 32 presents a smooth surface to the nosing of the stair C immediately above the uppermost stair B on which the machine is currently resting. Sufficient pulling force in the direction of arrow 30 will cause the machine 10 to be pulled upwardly over the flight of stairs and the nosing 32 facilitates the smooth upward passage of the machine 10 by virtue of its shaping. The lower surface 34 of the nose 32 provides a surface by means of which the forward portion of the machine 10 is guided smoothly over the nosing of stair C.

FIGS. 2*a*–2*d* illustrate the upward motion of the machine 10 when an upward force is applied to the hose 18 in the direction of the arrow 30. The position illustrated in FIG. 1 is again illustrated in FIG. 2*a* and will now be regarded as a starting position. Contact portions 28*a* and 28*b* are in contact with the treads of stairs A and B. The foremost extremity of nose 32 is in contact with or adjacent the nosing of stair C.

Application of a pulling force in the direction of the arrow 30 causes the machine 10 to ride upwardly over the stairs. Contact portions 28*a* and 28*b* move out of contact with the treads of stairs A and B and the machine is then supported on the nosings of stairs B and C by contact with the surface of the recess 26 (or another portion of the base 14 of the housing 12) and with the lower surface 34 of the nose 32 respectively. Continued pulling in the direction of the arrow 30 causes the machine 10 to ride further up on the nosings of stairs B and C until the machine is supported by contact with the base 14 of the housing 12 on either side of the recess

26. Eventually, the nosing of stair C will come into contact with at least one wall of the recess 26 whereupon the contact portions 28*a*, 28*b* will be brought into contact with the treads of stairs B and C. Further movement in the direction of arrow 30 will ensure that the contact portions 28*a*, 28*b* are positioned sufficiently far from the nosings of stairs B and C for the machine 10 to be stably supported. The new stable position is identical to that shown in FIG. 2*a* but with the machine 10 resting on stairs B and C instead of stairs A and B.

The embodiment illustrated in the accompanying drawings shows that the housing 12,12' incorporates cyclonic means for separating dirt and dust from the air flow drawn in through the hose 18,18'. This is a preferably feature but should not be regarded as limiting to the present invention.

I claim:

1. A vacuum cleaner comprising a housing containing an apparatus for separating dirt and dust from an airflow, a base of the housing incorporating an upwardly extending recess for accommodating a stair nosing, and contact portions arranged on either side of the recess for contacting two adjacent stair treads of a flight of stairs and supporting the vacuum cleaner thereon, the forward end of the housing having an upwardly inclined nose with a smooth, inclined lower surface wherein when the vacuum cleaner is supported on the two adjacent stair treads, the smooth lower surface extends towards an upper stair nosing immediately above the stair nosing accommodated by the recess and is inclined to the vertical so that the smooth, lower surface facilitates sliding of the vacuum cleaner in an upward direction over the flight of stairs.

2. A vacuum cleaner as claimed in claim 1, wherein the smooth, inclined lower surface is substantially planar.

3. A vacuum cleaner as claimed in claim 2, wherein the upwardly extending recess has a rearward inclined surface which is substantially parallel to the smooth, planar lower surface of the upwardly inclined nose.

4. A vacuum cleaner as claimed in any one of claims 1, 2 or 3, wherein the apparatus for separating dirt and dust from the airflow is cyclonic.

* * * * *

UNITED STATES PATENT AND TRADEMARK OFFICE

CERTIFICATE OF CORRECTION

PATENT NO. : 5,937,477

DATED : August 17, 1999

INVENTOR(S) : James Dyson

Figure 3A:
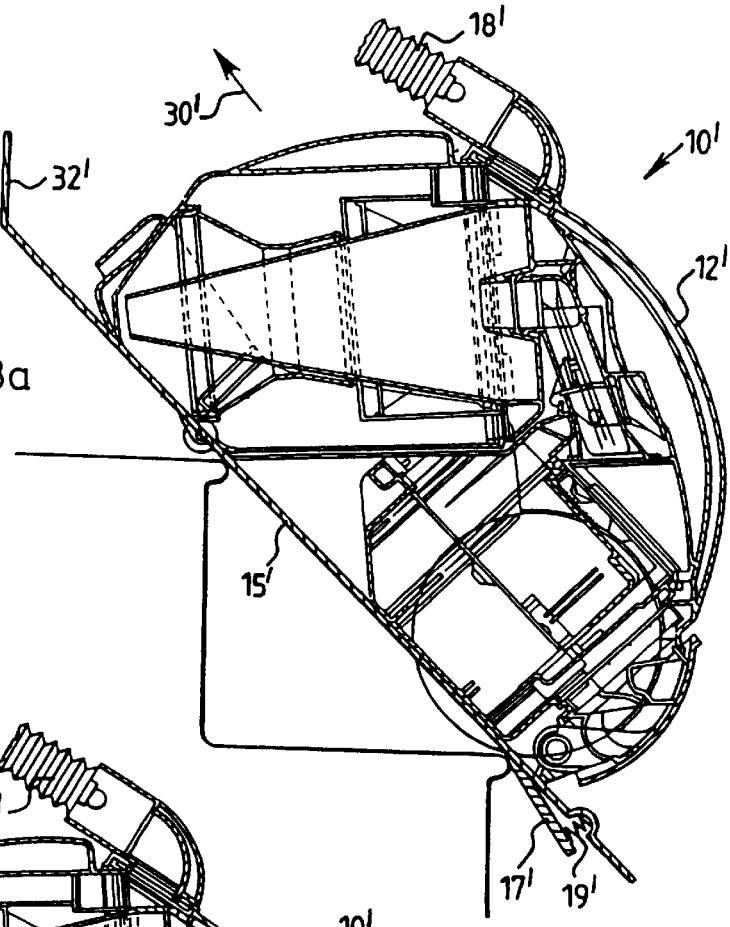
FIG. 3*a* and 3*b* shows an alternative embodiment of the invention.
Figure 3B:
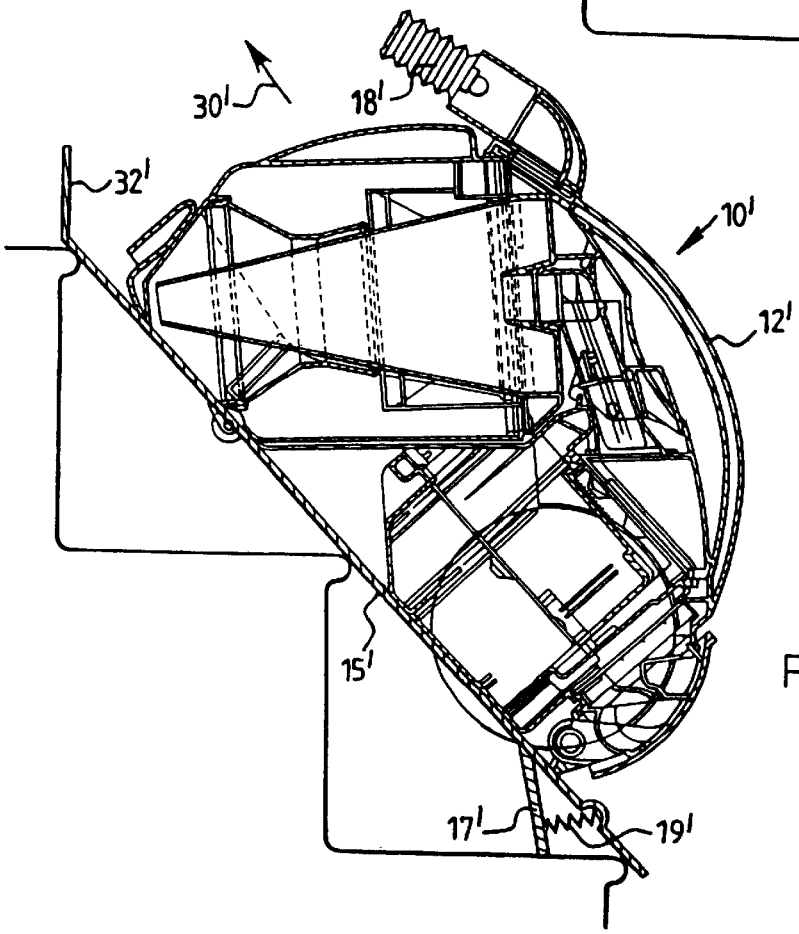

It is certified that error appears in the above-identified patent and that said Letters Patent is hereby corrected as shown below:

In the Drawings:

Delete Figures 3a and 3b from the patent.

Column 2, lines 4 and 5, delete "FIG. 3a and 3b shows an alternative embodiment of the invention."

Column 3, line 14, "preferably" should be --preferable--.

Signed and Sealed this

Twenty-fifth Day of April, 2000

*Attest:*

*Attesting Officer*

Q. TODD DICKINSON

*Director of Patents and Trademarks*